US005617073A

United States Patent [19]

Wilson

[11] Patent Number: 5,617,073

[45] Date of Patent: Apr. 1, 1997

[54] METHOD AND APPARATUS FOR LINKING AN OBJECT WITH A SLOT TO A CABLE

[75] Inventor: Edwin P. Wilson, Allison Park, Pa.

[73] Assignee: Minatronics Corporation, Allison Park, Pa.

[21] Appl. No.: 583,571

[22] Filed: Jan. 5, 1996

[51] Int. Cl.[6] ..... G08B 13/06

[52] U.S. Cl. ..... 340/568; 340/600; 340/652; 340/687

[58] Field of Search ..... 340/568, 687, 340/600, 652

[56] References Cited

U.S. PATENT DOCUMENTS

| | | | |
|---|---|---|---|
| 883,335 | 3/1908 | O'Connor | 340/568 |
| 4,639,713 | 1/1987 | Kitagawa et al. | 340/568 |
| 4,746,909 | 5/1988 | Israel et al. | 340/568 |
| 5,055,827 | 10/1991 | Philipp | 340/568 |
| 5,543,782 | 8/1996 | Rothbaum et al. | 340/568 |

*Primary Examiner*—Glen Swann
*Attorney, Agent, or Firm*—Ansel M. Schwartz

[57] ABSTRACT

Any attempt to remove the first element or the second element from the protected item will cause the ends of the sensor cable second element to pull out of the channels of the third element, or if the sensor cable is cut, a general failure to communicate signals between the various sensor cables will occur and this failure to communicate can be sensed by an alarm system thus causing an alarm condition.

14 Claims, 2 Drawing Sheets

METHOD AND APPARATUS FOR LINKING AN OBJECT WITH A SLOT TO A CABLE

FIELD OF THE INVENTION

The present invention relates to locks. More specifically, the present invention relates to an apparatus that links a cable to an object.

BACKGROUND OF THE INVENTION

With the advent of the use of computers and their associated accessories, there has been a proliferation of expensive but highly portable equipment such as laptop and handheld computers, external CD ROM drives, and tape backup devices. This equipment has appeared in such places as offices, schools, laboratories, and on display in retail stores, and needs to be secured. Traditional locks are used to prevent the theft of such equipment. However, because of the multitude of these products, it is impractical to always have someone present to prevent a thief from breaking the lock and removing the equipment.

There have been mechanical locks designed that can be slipped into the floppy drive of a computer in order to keep the computer from being used by unauthorized individuals. However, with the present invention, the computer can not only not be used, it can not be stolen nor even opened and the valuable internal parts can also not be removed without first setting off an alarm.

SUMMARY OF THE INVENTION

The present invention pertains to an apparatus for linking an object with a slot to a cable. The apparatus comprises a plate adapted for engagement within the slot of the object. The plate has a hole disposed therethrough. The apparatus also comprises a connection member having at least a first channel and a second channel for holding cable ends in communication with each other. Additionally, the apparatus comprises a cable member having a first end and a second and. The cable member has a length which allows it to slidably encircle the object passing through the hole of the plate in the slot with the first and second ends secured within the first and second channels, respectively to form a circuit, removal of the cable member from around the object can only occur by a break occurring in the circuit.

The present invention pertains to a cable security system. The system comprises an alarm unit having an output cable and an input cable. Additionally, the system comprises an apparatus for linking an object to the output cable and input cable with the output cable and input cable in communication with each other. The apparatus is preferably the apparatus described above. Preferably, the alarm unit comprises means for transmitting and receiving an optical signal through the input and output cable, respectively.

The present invention pertains to a method for securing an object to a cable alarm system comprising the steps of inserting a plate having a hole into a slot of the object. Next there is the step of encircling a cable member snugly around the object and through the hole with its ends secured in a connection member. Next, there is the step of connecting a cable alarm system to the connecting member such that a signal can pass from the alarm system through the cable member and back to the alarm system. Preferably, the object is a computer and the inserting step includes the step of placing the plate into a disk drive slot of the computer.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
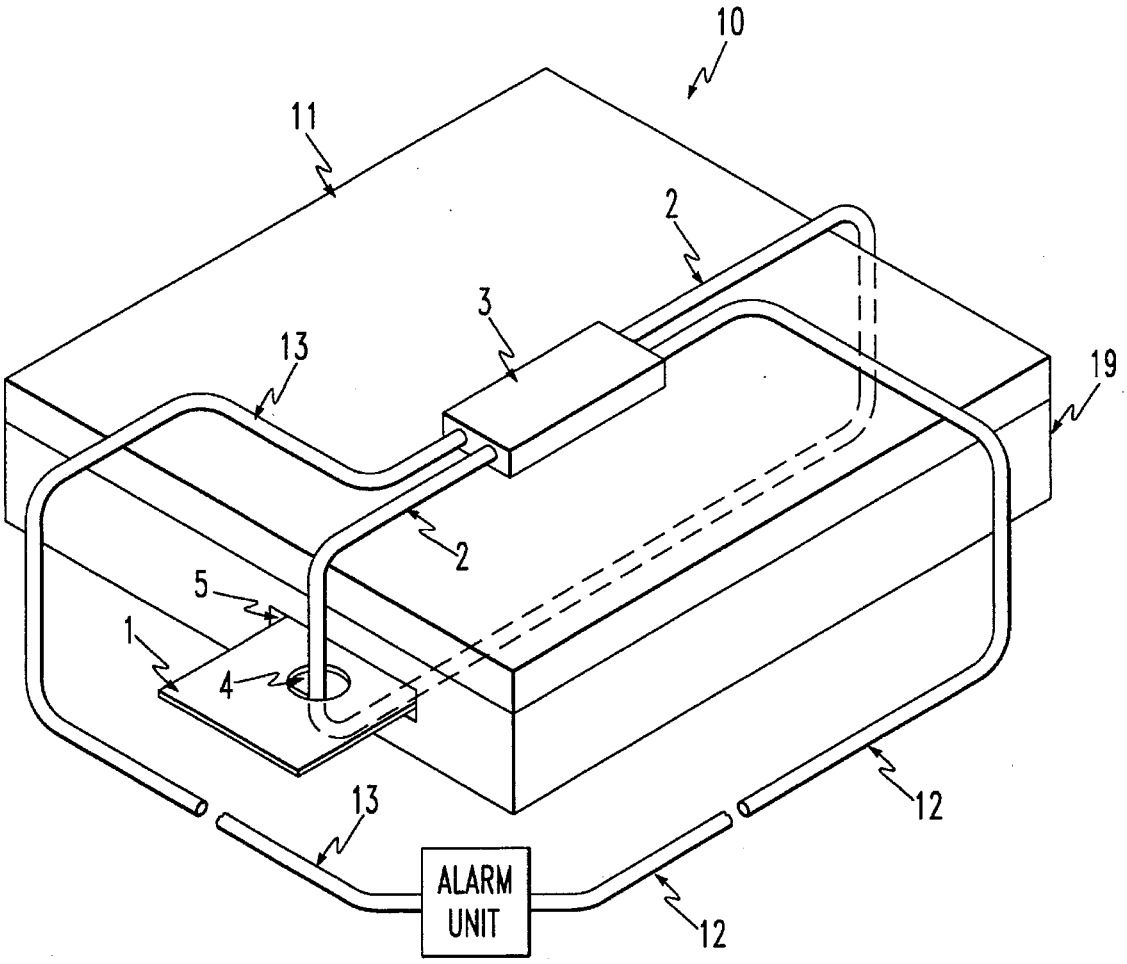
FIG. 1 is a schematic representation of an apparatus for linking a cable to an object.

Referring now to the drawings wherein like reference numerals refer to similar or identical parts throughout the several views, and more specifically to FIG. 1 thereof, there is shown a schematic representation of an apparatus 10 for linking an object 11 with a slot to a cable 2. The apparatus comprises a plate 1 adapted for engagement within the slot of the object 11. The plate 1 has a hole 4 disposed therethrough. The apparatus also comprises a connection member having at least a first channel 6–15 and a second channel 7–16 for holding cable ends in communication with each other. Additionally, the apparatus comprises a cable 2 having a first end 8 and a second end 9. The cable 2 has a length which allows it to slidably encircle the object 11 passing through the hole of the plate 1 in the slot with the first and second ends secured within the first and second channels 6, 7, respectively, to form a circuit with cable 12 and 13, removal of the cable 2 from around the object 11 can only occur by a break occurring in the circuit.

The connection member preferably has four channels. The cable 2 preferably comprises a retaining clip disposed on each end for releasably securing each end of the cable 2 within its respective channel. The cable 2 preferably comprises a fiber optic cable, although an electrically conducting cable 2 can also be used or other types of cable that transmit a signal which can be broken to call attention to the cable 2 through an alarm. Preferably, the plate 1 has a rectangular shape proportioned to fit within a disk drive slot 5 of the object 11.

The present invention pertains to a cable security system. The system comprises an alarm unit having an output cable 12 and an input cable 13. Additionally, the system comprises an apparatus for linking an object 11 to the output cable 12 and input cable 13 with the output and input of cable 2 in communication with each other. The apparatus is preferably the apparatus described above. Preferably, the alarm unit comprises means for transmitting and receiving an optical signal through the input and output cable 2, respectively.

The present invention pertains to a method for securing an object 11 to a cable alarm system comprising the steps of inserting a plate having a hole into a slot of the object 11. Next there is the step of encircling a cable 2 snugly around the object 11 and through the hole with its ends secured in a connection member. Next, there is the step of connecting a cable alarm system to the connecting member such that a signal can pass from the alarm system through the cable 2 and back to the alarm system. Preferably, the object 11 is a computer and the inserting step includes the step of placing the plate 1 into a disk drive slot 5 of the computer.

Figure 2:
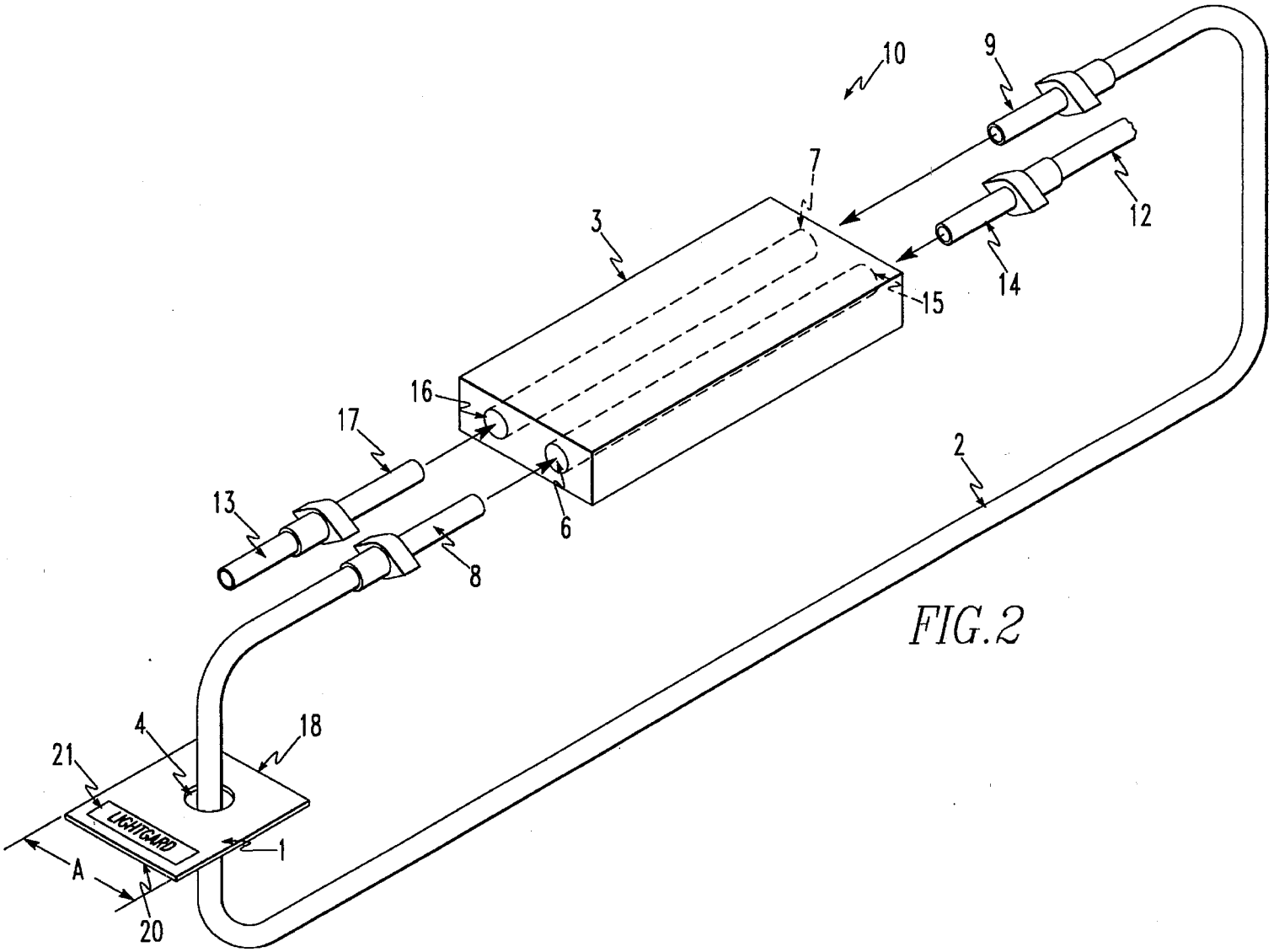
FIG. 2 is a schematic representation of the apparatus without the protected object being shown.

In the operation of the preferred embodiment, and referring to FIGS. 1 and 2, when sensor cable 2 is snapped into double splice point 3 and sensor cable ends 8, 9, 14, and 17 are held in place by retaining clip pressure, the length of sensor cable 2 is designed to be too short for the sensor cable 2 to be pulled over corner 19 of object 11 without one of the sensor cable ends 8 and/or 9 from disengaging itself from the channels of double splice point 3.

Preferably, plate 1 has lead edge 18 inserted far enough into floppy drive slot 5 so that it also can not be removed without one of the aforementioned sensor cable ends separating from the channels of double splice point 3. The width A of plate 1 in this case is approximately 3.5 inches so that it fits comfortably in the floppy drive slot 5 of a computer, and can not be slid sideways thus preventing sensor cable 2 from being removed from object 11. Different width plates can be used to protect various sizes and styles of openings.

FIG. 2 shows an enlarged view of the preferred embodiment where sensor cable 2 is a Fiber Optic cable or other type of cable which is capable of transmitting an electrical or optical signal. Double splice point 3 is AMP part 228045-1, or its equivalent, covered by U.S. Pat. No. 4,418,983 and sensor cable ends 8, 9, 14, and 17 are AMP Part number 228087-1, or its equivalent, which are also covered by U.S. Pat. No. 4,418,983. Part 1 is preferably an aluminum or non ferrous metal or strong plastic which can not create or impart a magnetic field inside a computer, CD ROM, Floppy Drive, or Tape Drive mechanism. In the preferred embodiment the distance on part 1 from channel 4 to the lead edge 18 is less than the length of what ever size floppy disk, or tape that will be used in the slot into which part 1 will be inserted so that upon insertion of part 1 into slot 5, which in FIG. 1 is shown as a floppy disk drive opening in a computer, it will not activate any portion of the delicate drive mechanism parts of the floppy drive. The size of the channel 4 will be slightly greater that 0.125 (⅛) inches in diameter if it is desirable to have the plate 1 remain with the 0.125 (⅛) inch diameter sensor cable 2 when it is not in use, or will be slightly greater that 0.3125 (5/16) inch in diameter if the male ends 8 and/or 9 of the sensor cable 2 are to be able to slide through the channel 4 when the sensor cable 2 is not in use. In the preferred embodiment, channel 4 will be located approximately one inch from trailing edge 20 of plate 1 so that a thief cannot easily cut the metal to release the sensor cable 2 and also so that a warning label or advertisement 21 can be placed so that it can easily be seen while the item 11 is being protected.

Referring again to FIG. 2 and FIG. 1 where Fiber Optic cables and connectors are being used, it can be seen that light entering through sensor cable 2 will pass through sensor cable end 14 which will be retained in channel 15 by double splice point 3. Double splice point 3 is so constructed so that sensor cable end 14 will butt up against sensor cable end 8 that has been inserted in channel 6. The light beam will therefore pass through sensor cable end 8 and on into sensor cable 2 which has been inserted through channel 4 of part 1 and will continue around object 11 as shown by FIG. 1. The light then passes through sensor cable end 9 which has been inserted through channel 7 of part 3. Sensor cable end 7 butts up against sensor cable end 17 which has been inserted in channel 16 of part 3 thereby allowing the light to pass on out through sensor cable 13 and return to the detector portion of the alarm system (not shown).

The apparatus allows a monitoring system to be easily integrated with equipment or objects that are desired to be protected. The apparatus provides a simple, versatile, inexpensive method to secure various types of valuable items such as computers and their accessories without drilling holes in the items that are to be protected so as to not void any manufacturer's warranties. The user of the apparatus will also not have to glue or permanently mount anything to his equipment which might be detrimental to the appearance of his equipment. In addition, the apparatus provides a simple method for protecting a laptop style computer from theft or from use regardless of whether the floppy disk is physically located on the front edge or side edge of the computer thus making the system adaptable to all brands of computers.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for linking an object with a slot to a cable comprising:

a plate adapted for engagement within the slot of the object, said plate having a hole disposed therethrough;

a connection member having at least a first channel and a second channel for holding cable ends in communication with each other; and a cable member having a first end and a second end, said cable member having a length which allows it to snugly encircle the object passing through the hole of the plate in the slot with the first and second ends secured within the first and second channels, respectively, to form a circuit, removal of the cable member from around the object can only occur by a break occurring in the circuit.

2. An apparatus as described in claim 1 wherein the connection member has four channels.

3. An apparatus as described in claim 2 wherein the cable member comprises a retaining clip disposed on each end for releasably securing each end of the cable member within its proper channel.

4. An apparatus as described in claim 3 wherein the plate has a shape proportioned to fit within a disk drive slot of the object.

5. An apparatus as described in claim 4 wherein the cable member comprises a fiber optic cable.

6. An apparatus as described in claim 5 wherein the plate has a rectangular shape.

7. A cable security system comprising:

an alarm unit having an output cable and an input cable; and an apparatus for linking an object to the output cable and input cable with the output cable and input cable in communication with each other, said apparatus comprising a plate engaged within a slot of the object and mechanism for connecting the input and output cables in communication with each other, said mechanism attached to said plate such that an attempt to remove the mechanism or plate from the object causes the input and output cables to break communication.

8. A cable security system as described in claim 7 wherein the connecting mechanism comprises a connection member having at least four channels for holding cable ends in communication with each other and a cable member having a first end and a second end, said cable member having a length which allows it to snugly encircle the object passing through a hold of the plate in the slot with the first and second ends secured within two channels of the connection member, said input and output cables disposed with the channels of the connection member in communication with the first and second cable ends.

9. An apparatus as described in claim 8 wherein the input cable, output cable and cable member are comprised of fiber optic cables and the alarm unit comprises means for transmitting and receiving an optical signal through the input and output cable, respectively.

10. An apparatus as described in claim 9 wherein the cable member comprises a retaining clip disposed on each end for releasably securing each end of the cable member within its proper channel.

11. An apparatus as described in claim 9 wherein the plate has a shape proportioned to fit within a disk drive slot of the object.

12. An apparatus as described in claim 11 wherein the plate has a rectangular shape.

13. A method for securing an object to a cable alarm system comprising the steps of:

inserting a plate having a hole into a slot of the object;

encircling a cable member snugly around the object and through the hole with its ends secured in a connection member; and connecting a cable alarm system to the connecting member such that a signal can pass from the alarm system through the cable member and back to the alarm system.

14. A method as described in claim 13 wherein the object is a computer and the inserting step includes the step of placing the plate into a disk drive slot of the computer.

* * * * *